US006109285A

United States Patent [19]

Kivioja et al.

[11] Patent Number: 6,109,285

[45] Date of Patent: Aug. 29, 2000

[54] METHOD AND ARRANGEMENT FOR AUTOMATIC MONITORING AND CORRECTION OF THE REGULATION PRESSURE IN REGULATION VALVES OF A VARIABLE-CROWN ROLL IN A PAPER MACHINE

[75] Inventors: Pekka Kivioja, Muurame; Juha Lahtinen, Jyväskylä , both of Finland

[73] Assignee: Valmet Corporation, Finland

[21] Appl. No.: 09/213,529

[22] Filed: Dec. 17, 1998

[30] Foreign Application Priority Data

Dec. 17, 1997 [FI] Finland ..... 974539

[51] Int. Cl.[7] ..... F17D 1/16

[52] U.S. Cl. ..... 137/14; 162/263; 162/358.1; 492/7; 492/16; 492/20

[58] Field of Search ..... 162/358.1, 263; 492/5, 7, 10, 20, 16; 137/557, 552, 14

[56] References Cited

U.S. PATENT DOCUMENTS 3,269,352 8/1966 Van Winkle ..... 137/557
4,464,921 8/1984 Surat ..... 72/243
4,644,860 2/1987 Brendel ..... 100/35
4,858,292 8/1989 Buhlmann et al. ..... 29/116.2

*Primary Examiner*—Denise L. Ferensic
*Assistant Examiner*—Kenneth B. Rinehart
*Attorney, Agent, or Firm*—Steinberg & Raskin, P.C.

[57] ABSTRACT

Method and arrangement for automatic monitoring and correction of the regulation pressure of regulation valves in a regulation valve block in a variable-crown roll in a paper machine. The regulation pressure of the regulation valve in each regulation zone in the regulation valve block can be connected alternatingly to a reference pressure detector whose measurement signal is compared with the measurement signal of the actual value of the regulation pressure in the regulation zone concerned. The result of the comparison is stored on the page of monitoring of pressure detectors contained in the central computer system, on which page, in addition to this difference, set values and actual values of the regulation zone pressures as well as the value of the reference measurement are provided. In addition, a correction can be made to the actual value of the regulation pressure in the regulation zone concerned if the difference between the measurement signal of the reference pressure detector and the measurement signal of the actual value of the regulation pressure in the regulation zone concerned is higher than a predetermined value.

10 Claims, 2 Drawing Sheets

143
141
CZ
Z1-Z24

CZ
MCZ
CZ
A
B
P
X
Y
L
L
P
T
201

Z1
101
A
B
P
T
A
B
P
T
Z1
NZ1
MZ1
MZ
P
T
120
100
SV1

BHP
CZ
Z1
Z2
Z22
Z23
Z24
MP MT
T
P
TMZ
131

METHOD AND ARRANGEMENT FOR AUTOMATIC MONITORING AND CORRECTION OF THE REGULATION PRESSURE IN REGULATION VALVES OF A VARIABLE-CROWN ROLL IN A PAPER MACHINE

FIELD OF THE INVENTION

The present invention relates to methods and arrangements for automatic monitoring of regulation pressure in regulation valves in a regulation valve block of a paper machine roll, in particular a variable-crown roll, including a regulation valve block having ducts through which pressure medium is passed to the regulation valves.

BACKGROUND OF THE INVENTION

In a paper machine environment, in order to measure a force, for example, a linear load, the pressure is usually measured. Pressure transmitters or detectors act as feedback members of force regulation circuits. In present-day lines of manufacture of paper, there are, on the average, about 500 points at which the pressure is measured.

Pressure detectors and regulation electronics of regulation valves always involve a certain extent of creep, as a result of which their regulation values may change in the course of time. For this reason, such regulation values should be checked at regular intervals. Since the number of points to be checked is high, it is desirable to make checking of the regulation pressures of regulation valves automatic in order that the pressure of each pressure transmitter or detector should not have to be checked separately manually.

In the prior art, calibration of the pressure detectors of regulation valves is carried out manually so that all pressure detectors of regulation valves at an object to be regulated are calibrated at regular intervals. In such a case, it has been necessary to carry out an abundance of unnecessary work, because calibration has not been necessary for some of the pressure detectors of the regulation valves. Since the amount of work used for manual calibration is considerable in the case of a large number of valves, calibration has been carried out relatively seldom, in which case, some of the pressure detectors of regulation valves may already have crept to a relatively great extent. Those pressure detectors of regulation valves that have crept pass either an excessively high or an excessively low pressure to the object to be regulated, which is, of course, an undesirable situation.

There are also applications in which the pressure transmitter that acts as the feedback member of the regulation circuit has been doubled, in which case, one pressure transmitter operates as a reference transmitter. In monitoring that has been carried into effect in this way, it is, however, not known which pressure transmitter shows the correct reading. In such an application, the condition of the reference transmitter should always be known.

OBJECTS AND SUMMARY OF THE INVENTION

An object of the present invention is to provide a method by whose means the creep of the pressure detectors and regulation electronics of the regulation valves of a variable-crown roll in a paper machine can be monitored and corrected automatically.

Another object of the present invention is to provide new and improved methods and arrangements for automatic monitoring and correction of the regulation pressure in regulation valves of a variable-crown roll in a paper machine.

It is another object of the present invention to provide new and improved methods and arrangements for automatic monitoring and correction of the regulation pressure in regulation valves of a variable-crown roll in a paper machine while avoiding the problems occurring in the prior art discussed above.

In order to achieve these objects, and others, one embodiment of a method for automatic monitoring of regulation pressure in regulation valves in a regulation valve block of a variable-crown roll in a paper machine in accordance with the invention comprises the steps of associating a group of at least two of the regulation valves with a reference pressure detector, providing a flow communication between each regulation valve in the group of regulation valves alternatingly to the reference pressure detector associated therewith such that the reference pressure detector generates a measurement signal representative of the measured regulation pressure of each regulation valve, and comparing the measurement signal representative of the measured regulation pressure of each regulation valve with a measurement signal representative of the actual regulation pressure of the regulation valve to determine whether the measured regulation pressure differs from the actual regulation pressure. The reference -pressure detector may be common to all of the regulation valves in the regulation valve block, in which case, a flow communication between each regulation valve in the regulation valve block is provided alternatingly to the common reference pressure detector. The actual regulation pressure of each regulation valve may be adjusted or corrected if the difference between the measured regulation pressure and the actual regulation pressure exceeds a predetermined value.

Another embodiment of a method for automatic monitoring of regulation pressure in regulation valves in a regulation valve block of a variable-crown roll in a paper machine in accordance with the invention comprises the steps of providing a reference pressure detector, verifying a zero point of the reference pressure detector, providing a flow communication between the regulation valve in a first regulation zone of the variable-crown roll to the reference pressure detector such that the regulation pressure effective in the regulation valve is effective at the reference pressure detector, during a predetermined cycle of measurement, generating a measurement signal representative of the actual regulation pressure of the regulation valve and a measurement signal representative of the pressure detected by the reference pressure detector, and determining any difference between the measurement signal representative of the actual regulation pressure of the regulation valve and the measurement signal representative of the pressure detected by the reference pressure detector. Any differences are stored in a control system and the flow communication between the regulation valve to the reference pressure detector is then closed and a measurement line of the reference pressure detector is emptied into a tank line. Thereafter, a flow communication between the regulation valve in each of the remaining regulation zones of the variable-crown roll to the reference pressure detector is provided, e.g., sequentially, and the measurement signal generating step, difference determining and storing steps and closing and emptying steps are repeated. The zero point of the reference pressure detector may be verified by connecting an inlet duct of the reference pressure detector to the atmosphere, and interrupting the monitoring operation if the difference between the measurement signal of the reference pressure detector having its inlet duct connected to the atmosphere and a measurement signal corresponding to a value of 0 bar is higher than a predetermined value. The step of determining any difference between the measurement signal representative of the actual regulation pressure of the regulation valve and the measurement signal representative of the pressure detected by the reference pressure detector may entail determining any difference between average values of the measurement signals of the actual regulation pressure of the regulation valve and the pressure measured by the reference pressure detector. If the difference between the average values of the measurement signals of the actual regulation pressure of the regulation valve and the pressure measured by the reference pressure detector is excessively high, the actual regulation pressure passed to the regulation valve may be adjusted with a value that corresponds to this difference such that a desired pressure is obtained in the output of the regulation valve.

The arrangement for automatic monitoring of regulation pressure in regulation valves in a regulation valve block of a variable-crown roll in a paper machine in accordance with the invention comprises at least one group of first seat valves, each enabling flow communication between a respective regulation valve and a measurement line of the group of first seat valves, at least one reference pressure detector for measuring the regulation pressure of the regulation valves, each reference pressure detector being associated with a respective group of first seat valves and being connected to the measurement line of the respective group of first seat valves, at least one second seat valve, each associated with a respective reference pressure detector for connecting the same to the atmosphere and being connected to the measurement line of the respective group of first seat valves associated with that reference pressure detector, and at least one third seat valve, each associated with a respective reference pressure detector for connecting the measurement line of the respective group of first seat valves associated with the reference pressure detector to a tank line.

By means of the method and arrangement in accordance with the present invention, it is possible to monitor and to correct the zero point creep of the pressure detectors and regulation electronics of the regulation zones of a variable-crown roll in a paper machine in a centralized way and fully automatically. In such a case, it is efficiently possible to reduce the amount of work used for monitoring, and, at the same time, the quality of the work is improved. Further, by means of centralized automatic monitoring, it is possible, as compared with conventional manual calibration, to eliminate calibration of such pressure detectors of regulation valves which do not need calibration. When the pressure detectors that have crept are identified, the setting of an actual value to be assigned to these detectors can be altered so that the error involved in them is compensated. For example, if a regulation valve provides a pressure 1.5 bar higher than the pressure requested from it, this pressure difference of 1.5 bar can be reduced from the pressure request to be transmitted to the valve, in which case the regulation valve provides the desired regulation pressure at its output. In connection with the following standstill, the pressure detectors that have crept are, of course, calibrated, after which a correct actual value of pressure can again be fed to them without correction.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figures 1A, 1B, 1C, 1D:
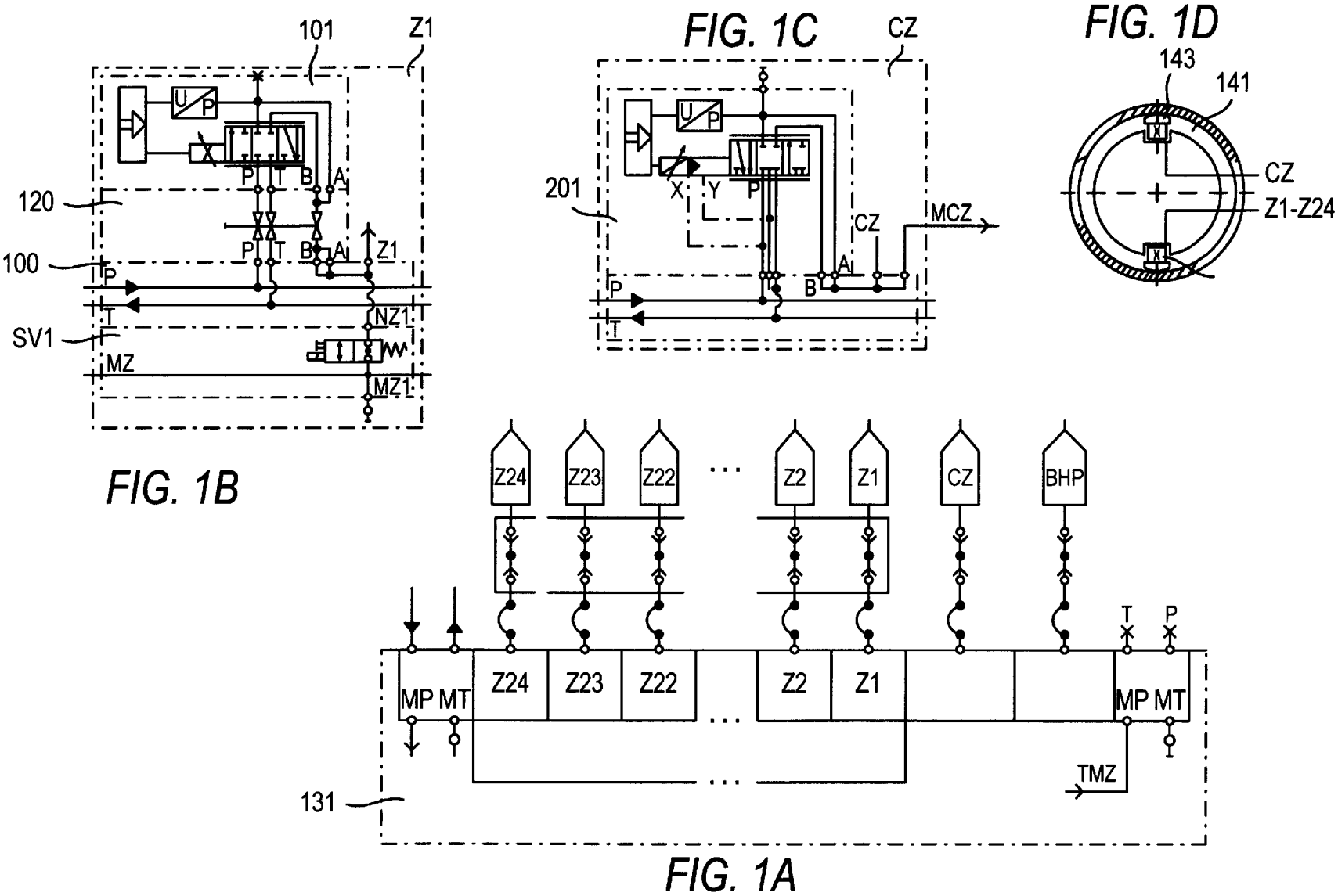
FIGS. 1A–1D shows hydraulic diagrams related to the regulation circuits of a variable-crown roll in a paper machine, which diagrams show the principal parts of the regulation circuits.

Referring to the accompanying drawings wherein like reference numerals refer to the same or similar elements, FIGS. 1A–1D illustrate hydraulic diagrams of a variable-crown roll in a paper machine, in which the principal parts of the regulation circuits are seen. More specifically, FIG. 1A shows the main block 131, FIG. 1B shows the regulation devices connected with one regulation zone Z1, FIG. 1C shows the regulation devices connected with the backup zones CZ, and FIG. 1D is a sectional view illustrating the principle of a variable-crown roll 141.

In this exemplifying embodiment, the variable-crown roll has been divided, in its axial direction, i.e., across the width of the paper web, into separately adjustable regulation zones or circuits Z1, . . . ,Z24. Each regulation zone Z1, . . . ,Z24 includes a number of hydraulic loading elements 142 installed between the roll axle and an inner face of the roll mantle. By means of the loading elements 142, bending of the roll mantle can be varied. Loading elements 142 are directed at the nip point of the roll. At the opposite side of the roll, in relation to the nip point, loading elements 143 are arranged between the roll axle and the inner face of the roll mantle. Loading elements 143 are situated in what are called backup zones or circuits CZ, and these backup zones CZ are normally provided exclusively at the ends of the roll (although they are not limited to such placement). By means of the loading elements 143 provided in the backup zones CZ, the regulation of the linear load at the nip point of the roll can be adjusted so as to achieve further precision.

FIG. 1A shows the main block 131 to which regulation circuits Z1, . . . ,Z24 and CZ are connected. Further, a regulation circuit BHP departing to the bearings is connected to the main block 131. In the top portion at the left side of the main block 131, the ducts passing to a pressure medium source P and to a tank line T are shown. Opposite to these ducts, additionally the measurement point MP for the feed pressure of the pressure medium source is shown (to which measurement point a reference pressure detector can be connected), and the point MT is shown, which passes to the tank line T. Similarly, in the top portion at the right side of the main block 131, alternative connections passing to the pressure medium source P and to the tank line T are shown, which connections have been provided with plugs. Opposite to these connections, the connection of the pressure limiter valve TMZ, shown in FIG. 2, with the tank line MT and the connection with the pressure medium feed line MP are shown.

Figure 2:
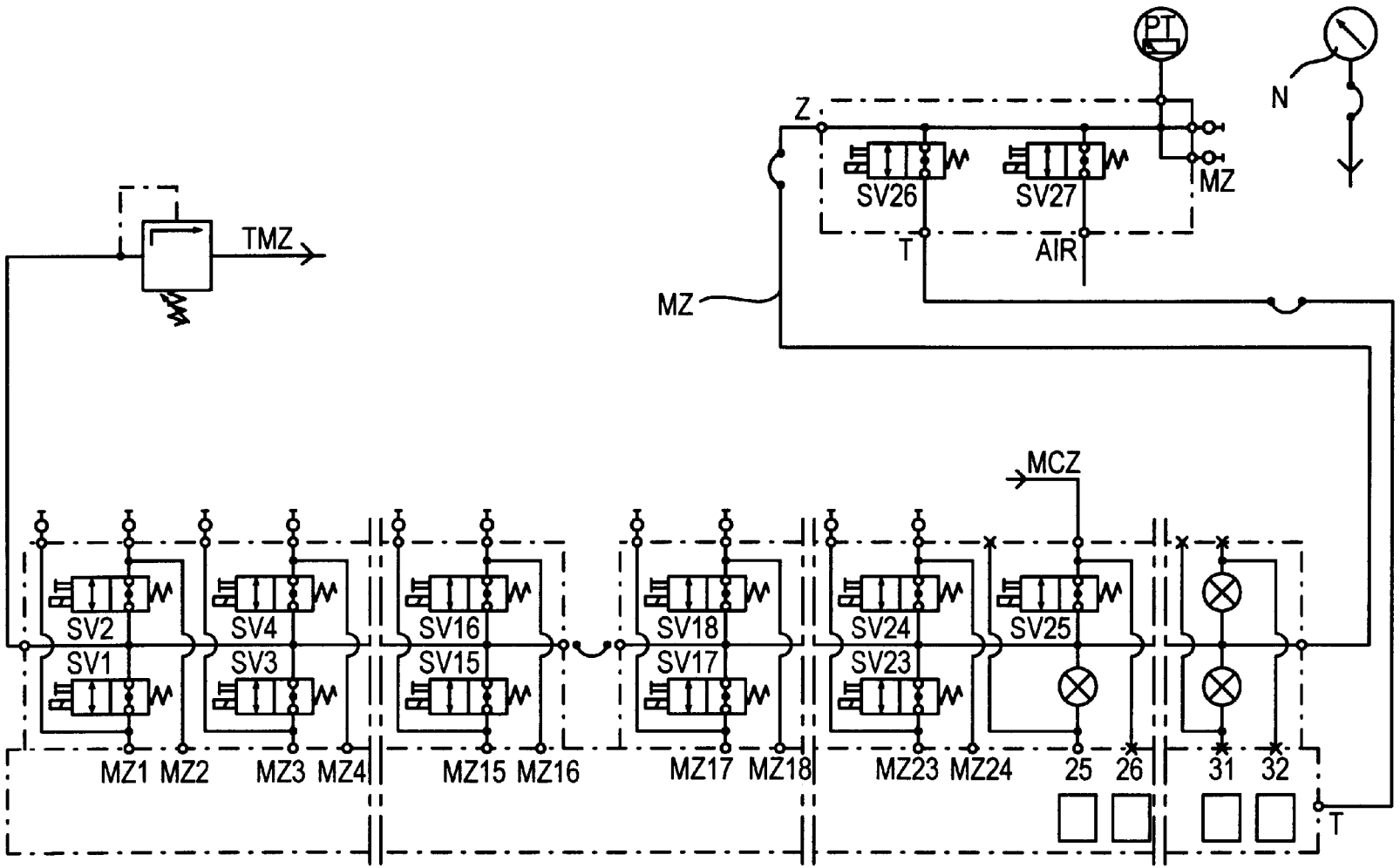
FIG. 2 shows a hydraulic diagram related to the regulation circuit of a variable-crown roll in a paper machine, which diagram shows the circuit of monitoring of the pressure detectors of the regulation valves in one block of regulation valves.

FIG. 1B shows the regulation devices connected with one regulation zone Z1 of the variable-crown roll in a paper machine, i.e., a regulation valve 101, a closing valve 120, a regulator valve block 100 and a seat valve SV1. Pressure medium ducts A and B departing from the regulation valve 101 are connected through a duct or line Z to the loading elements 142 of one regulation zone Z1 in the variable-crown roll. In the regulation valve block 100, a pressure medium duct P passing to the pressure source (not shown in the figure) and a pressure medium duct T passing to the pressure medium tank (not shown in the figure) are provided. From the pressure medium duct Z that passes to the variable-crown roll, there is also a connection through the seat valve SV1 to the pressure medium duct MZ, which passes to the reference pressure detector PT (FIG. 2).

FIG. 1C shows the regulation circuit connected with the backup zone CZ in the variable-crown roll. The pressure medium ducts A and B departing from a regulation valve 201 are connected through a line to the backup zone CZ in the variable-crown roll. The number of these backup zones CZ is normally two, one at each end of the roll. In such a case, each backup zone is controlled by means of a regulation circuit of its own, whose pressure settings are kept equal. Further, the pressure medium ducts A and B departing from the regulation valve 201 are connected through the line MCZ with a seat valve SV25 shown in FIG. 2 so that the regulation valve 201 can be connected to the reference pressure transmitter PT through seat valve SV25.

FIG. 1D illustrates the connections of the outputs of the regulation valves 101,201 of the regulation circuits of zones Z1, . . . , Z24 and CZ to the variable-crown roll 141. Each regulation circuit of zones Z1, . . . ,Z24 is connected to the loading elements 143 in the regulation zone concerned, and each regulation circuit of backup zone CZ is connected in a similar way to the loading elements 142 in the backup zone concerned.

From the point of view of the present invention, the connection of the outputs of the regulation valves 101 of the regulation blocks Z1, . . . ,Z24 to their monitoring circuit and to the reference pressure transmitter PT placed in this circuit are the subject of primary interest, and this will be described in the following with reference to FIG. 2.

FIG. 2 shows the means for monitoring the regulation valves 101 connected with the regulation zones Z1, . . . ,Z24 in the regulation valve block 100 of the variable-crown roll in a paper machine. By means of seat valves SV1, . . . ,SV24, the output Z of each regulation valve 101 can be connected to the measurement line MZ. The measurement line MZ is again connected to the reference pressure detector PT, by whose means the output pressure Z of the regulation valve 101 of each regulation zone Z1, . . . ,Z24 can be measured. Further, the measurement line MZ can be connected through a seat valve SV27 directly to the air surrounding the apparatus, in which case it is possible to check the zero point of the reference pressure detector PT. The measurement line MZ can also be connected through a seat valve SV26 to the tank line T in order to empty the measurement line MZ. The measurement pressure of the reference pressure detector PT is shown in the display N.

FIG. 2 also shows the pressure limitation valve TMZ through which an excessive pressure, if any, is discharged into the tank (see FIG. 1A). The measurement line MCZ of the backup zone CZ, shown in FIG. 1C, is connected to the seat valve SV25, in which case, the output pressure of the regulation valve 201 of the backup zone CZ can also be connected, by means of the seat valve SV25, to the measurement line and through this line to the reference pressure detector PT. In FIG. 2, at the right side, below the seat valve SV25 and at its right side, three plugged bores are shown, to which further seat valves can be connected if necessary.

In the following, the operation of the device will be described in connection with a variable-crown roll. The regulation pressure of each regulation zone Z1, . . . ,Z24 can be connected, in its turn, to the reference pressure detector PT, whose measurement signal is compared with the actual value of the regulation pressure in the regulation zone Z1, . . . ,Z24. The result of the comparison, i.e., the difference between the actual value of regulation pressure and the pressure value measured by the reference pressure detector, is stored on a pressure-transmitter monitoring page provided in the central computer system. On the monitoring page, besides the difference between the pressure values, also the set values and actual values of the zone pressures and the value of the reference measurement are given. When the result of comparison exceeds a permitted difference value, an alarm is effected by changing the color of the monitoring line of the zone concerned. In connection with the following programmed standstill or in a normal operation situation when the machine runs, the zero point of the pressure detector whose setting has changed can be corrected to the correct value.

This examination is based on the assumption that the creep that has been measured consists of creep of the zero point of the pressure detector alone, which is the error of precision that occurs most commonly. A creep of sensitivity, i.e., of the pressure value corresponding to maximal measurement signal, changes the angle coefficient of the pressure detector (pressure/flow interdependence), and the monitoring of this change requires measurement of two points. If necessary, the sensitivity can be checked during a standstill.

For simultaneous regulation of the zero points of all pressure detectors, the system is provided with a state of calibration of the pressure detectors. In this calibration state, an equal regulation pressure, for example 5 bar, is passed to all the regulation zones Z1, . . . ,Z24. In the calibration state, the nip is open, the rolls do not revolve, the system of valves communicates with the roll in the normal way, and the system is at the normal operating temperature.

The monitoring of the pressure detectors takes place automatically at regular intervals. The checking interval can be, for example, twice a week. In a checking situation, the following cycle of operations is carried out:

1. Initially, the zero point of the reference pressure detector PT is checked so that the seat valve SV27 is opened, in which connection the reference pressure detector PT is connected to the outdoor atmospheric pressure. In this connection, all the other seat valves SV1, . . . ,SV26 must be in the closed position. When about 10 seconds have elapsed from the opening, the measurement signal of the reference pressure detector PT is stored, and the value is transferred to the pressure-detector monitoring page for the regulation valves 11 to the line of the reference pressure detector PT. If the measurement signal differs from the value 0 bar by more than about 0.7 bar, the line of the reference pressure detector PT is colored with the alarm color, and the monitoring operation is interrupted. The monitoring operation is not started until the reference pressure detector PT has been adjusted and the alarm signal been removed. As the reference pressure detector, it is possible to use, for example, a detector designated the Valmet-Press PTS which can be calibrated by means of a Hart bus. If the shift of the zero point of the reference pressure detector PT is smaller than 0.7 bar, the shift is stored so that it can be taken into account when the zone pressures are examined by eliminating the effect of the shift from the measurement signal of the reference pressure detector PT.

2. The set value of the regulation pressure of the regulation zone Z1, . . . ,Z24 to be checked is stored. It is checked whether a pressure change gradient is not running or about to start.

3. The seat valve SV1 of the first regulation zone Z1 is opened by passing the voltage to the coil of the seat valve SV1, in which connection the regulation pressure is connected to the reference pressure detector PT. The waiting time is about 3 seconds before moving to point 4. When the seat valve SV1 is under control, the light is on in the LED plug of the seat valve SV1.

4. The duration of the measurement cycle is determined as the desired period of time, for example 10 seconds. During the measurement cycle, the actual value of the regulation pressure of the regulation valve 11 and the measurement signal of the reference pressure detector PT are stored. Upon completion of the measurement cycle, it is checked whether the set value of the regulation pressure of the regulation valve 11 has remained invariable. If the set value has changed during measurement, the measurement that was carried out is rejected, and a new measurement is started. Upon completion of a successful measurement cycle, the difference between the average values of the measurement signals of the actual values of the regulation pressure of the regulation valve 11 and the measurement signals of the pressure measured by the reference pressure detector PT are computed. The reading is stored on the pressure-detector monitoring pages for the regulation valves 11. If the difference exceeds the permitted value, the color of the line concerned is changed. As a permitted value, it is possible to consider, for example, the value of 1 bar.

5. The seat valve SV1 is closed by removing the control voltage from it. After about 2 seconds have elapsed from the switching off of the control voltage, the measurement line of the reference pressure detector PT is emptied into the tank line T by passing the control voltage to the coil of the seat valve SV26. The seat valve SV26 is kept in the open position for a period of about 3 seconds.

6. The cycle moves to the next regulation zone Z2, and the points 2–5 are repeated.

When adjustment of the zero points of the pressure detectors is carried out in connection with a standstill, the system is shifted into the state of calibration of the pressure detectors described above. The seat valves SV1, . . . ,SV27 can also be controlled by means of manual control knobs. The reference pressure detector PT is provided with a digital display N, and by means of a manual control pin, the desired pressure can be controlled to the display of the reference pressure detector PT.

Replacement of a regulation valve 101 can be carried out while the machine runs so that the regulation valve connections are closed by means of a closing valve 120 placed below the valve, which valve is described in the inventors' U.S. patent application, filed on the same day herewith, which corresponds to Finnish patent application Ser. No. 974540 and which is incorporated by reference herein in its entirety. When the replacement operation starts, the seat valve SV1, . . . ,SV24 of the regulation valve to be replaced is opened by activating the valve replacement state of the zone Z1, . . . ,Z24 concerned from the control terminal. Opening of the seat valve SV1, . . . ,SV24 reduces the pressure shock that may be caused in the zone closed by the closing valve 120 by an instant-opening operation possibly occurring in connection with a replacement of a valve.

Above, an operation of monitoring of the regulation pressures of pressure valves has been described, by whose means it is possible to determine the regulation valves in which creeping has occurred so that the factual output pressures of the regulation valves no longer correspond to the set values of the regulation pressures. In addition to this, by means of the method in accordance with the present invention, correction of the output pressures of the regulation valves that have crept excessively can also be carried out.

Correction of the output pressures can be carried out so that, in those cases in which the difference between the average values of the measurement signals of the actual values of the regulation pressure of the regulation valve 101 and the measurement signals of the pressure measured by the reference pressure detector PT is excessively large, the actual value of the regulation pressure passed to the regulation valve concerned is corrected with the value corresponding to this difference. In this manner, the desired pressure is obtained in the output of the regulation valve. In connection with the next standstill, the pressure detectors of the regulation valves that have crept can be calibrated, after which, the correction of the actual value can be eliminated.

Above, with reference to FIG. 2, a preferred embodiment of the method and arrangement in accordance with the present invention has been described, in which one common reference pressure detector PT is employed, to which detector, all the regulation valves Z1, . . . ,Z24 in the regulation valve block can be connected alternatingly by means of a common line MZ of measurement of regulation pressure.

The invention can, of course, also be applied in a situation in which the regulation valves 101 in the regulation zone Z1, . . . ,Z24 in the regulation valve block are divided into groups so that each group of regulation valves includes at least two regulation valves. In such a case, each group of regulation valves has a regulation pressure measurement line MZ of its own and a reference pressure detector PT of its own connected with the measurement line MZ as well as seat valves SV26,SV27 connected with the reference pressure detector PT. In such a case, the operation of monitoring of each group of regulation valves corresponds to the monitoring operation described in relation to FIG. 2.

The examples provided above are not meant to be exclusive. Many other variations of the present invention would be obvious to those skilled in the art, and are contemplated to be within the scope of the appended claims. Thus, the invention has been described above only with reference to some of its advantageous embodiments. However, the invention is not intended to be narrowly confined to the disclosed embodiments. Numerous variations and modifications are possible within the scope of the inventive idea defined in the following claims.

We claim:

1. A method for automatic monitoring of regulation pressure in regulation valves in a regulation valve block of a variable-crown roll in a paper machine, comprising the steps of:

associating a group of at least two of the regulation valves with a reference pressure detector, providing a flow communication between each of the regulation valves in the group of regulation valves alternatingly to the reference pressure detector associated with the group of regulation valves such that the reference pressure detector generates a measurement signal representative of a measured regulation pressure of each regulation valve, and comparing the measurement signal representative of the measured regulation pressure of each regulation valve with a measurement signal representative of an actual regulation pressure of the regulation valve to determine whether the measured regulation pressure differs from the actual regulation pressure.

2. The method of claim 1, wherein the reference pressure detector is common to all of the regulation valves in the regulation valve block, further comprising the step of:

providing a flow communication between each of the regulation valves in the regulation valve block alternatingly to the common reference pressure detector.

3. The method of claim 1, further comprising the step of:

adjusting the actual regulation pressure of each regulation valve if the difference between the measured regulation pressure and the actual regulation pressure exceeds a predetermined value.

4. A method for automatic monitoring of regulation pressure in regulation valves in a regulation valve block of a variable-crown roll in a paper machine, comprising the steps of:

providing a reference pressure detector, verifying a zero point of the reference pressure detector, providing a flow communication between the regulation valve in a first regulation zone of the variable-crown roll to the reference pressure detector such that the regulation pressure effective in the regulation valve is effective at the reference pressure detector, during a predetermined cycle of measurement, generating a measurement signal representative of an actual regulation pressure of the regulation valve and a measurement signal representative of a pressure detected by the reference pressure detector, determining any difference between the measurement signal representative of the actual regulation pressure of the regulation valve and the measurement signal representative of the pressure detected by the reference pressure detector, storing any differences in a control system, closing the flow communication between the regulation valve to the reference pressure detector and emptying a measurement line of the reference pressure detector into a tank line, and providing a flow communication between the regulation valve in the remaining regulation zones of the variable-crown roll to the reference pressure detector and repeating the measurement signal generating step, difference determining and storing steps and closing and emptying steps.

5. The method of claim 4, wherein the step of verifying the zero point of the reference pressure detector comprises the steps of:

connecting an inlet duct of the reference pressure detector to the atmosphere, and interrupting the monitoring operation if the difference between the measurement signal of the reference pressure detector having its inlet duct connected to the atmosphere and a measurement signal corresponding to a value of 0 bar is higher than a predetermined value.

6. The method of claim 4, wherein the step of determining any difference between the measurement signal representative of the actual regulation pressure of the regulation valve and the measurement signal representative of the pressure detected by the reference pressure detector comprises the step of determining any difference between average values of the measurement signals of the actual regulation pressure of the regulation valve and the pressure measured by the reference pressure detector.

7. The method of claim 6, further comprising the step of:

if the difference between the average values of the measurement signals of the actual regulation pressure of the regulation valve and the pressure measured by the reference pressure detector is excessively high, adjusting the actual regulation pressure passed to the regulation valve with a value that corresponds to this difference such that a desired pressure is obtained in the output of the regulation valve.

8. An arrangement for automatic monitoring of regulation pressure in regulation valves in a regulation valve block of a variable-crown roll in a paper machine, comprising at least one group of first seat valves, each of said first seat valves enabling flow communication between a respective one of the regulation valves and a measurement line of said at least one group of first seat valves, at least one reference pressure detector for measuring the regulation pressure of the regulation valves, each of said at least one reference pressure detector being associated with a respective one of said at least one group of first seat valves and being connected to said measurement line of the respective one of said at least one group of first seat valves, at least one second seat valve, each of said at least one second seat valve being associated with a respective one of said at least one reference pressure detector for connecting said reference pressure detector to the atmosphere and being connected to said measurement line of the respective one of said at least one group of first seat valves associated with said reference pressure detector, and at least one third seat valve, each of said at least one third seat valve being associated with a respective one of said at least one reference pressure detector for connecting said measurement line of the respective one of said at least one group of first seat valves associated with said reference pressure detector to a tank line, wherein said at least one group of first seat valves comprises all of said first seat valves in the roll and said at least one reference pressure detector comprises a single reference pressure detector common to all of said first seat valves such that said first seat valves lead to a common measurement line, said at least one second seat valve comprising a single second seat valve connected to said common measurement line for connecting said reference pressure detector to the atmosphere, and said at least one third seat valve comprising a single third seat valve connected to said common measurement line for enabling said common measurement line to be emptied into the tank line.

9. An arrangement for automatic monitoring of regulation pressure in regulation valves in a regulation valve block of a variable-crown roll in a paper machine, comprising at least one group of first seat valves, each of said first seat valves enabling flow communication between a respective one of the regulation valves and a measurement line of said at least one group of first seat valves, at least one reference pressure detector for measuring the regulation pressure of the regulation valves, each of said at least one reference pressure detector being associated with a respective one of said at least one group of first seat valves and being connected to said measurement line of the respective one of said at least one group of first seat valves, at least one second seat valve, each of said at least one second seat valve being associated with a respective one of said at least one reference pressure detector for connecting said reference pressure detector to the atmosphere and being connected to said measurement line of the respective one of said at least one group of first seat valves associated with said reference pressure detector, and at least on e third seat valve, each of said at least one third seat valve being associated with a respective one of said at least one reference pressure detector for connecting said measurement line of the respective one of said at least one group of first seat valves associated with said reference pressure detector to a tank line wherein said at least one reference pressure detector comprises a plurality of reference pressure detectors, each of said reference pressure detectors being associated with a respective one of said groups of first seat valves and being connected to said measurement line of the respective one of said groups o f first seat valves.

10. The arrangement of claim 9, wherein said at least one reference pressure detector comprises a plurality of reference pressure detectors, each of said reference pressure detectors being associated with a respective one of said groups of first seat valves and being connected to said measurement line of the respective one of said groups of first seat valves.

* * * * *